US005690024A

United States Patent [19]

Järund

[11] Patent Number: 5,690,024

[45] Date of Patent: Nov. 25, 1997

[54] WASTE PAPER COLLECTING DEVICE

[76] Inventor: Olle Järund, Badbergsgatan 3, S-450 71, Fjällbacka, Sweden

[21] Appl. No.: 604,109

[22] Filed: Feb. 20, 1996

[30] Foreign Application Priority Data

Mar. 14, 1995 [EP] European Pat. Off. ..... 95850056.3

[51] Int. Cl.[6] ..... B65B 27/08

[52] U.S. Cl. ..... 100/34; 53/390; 53/592; 211/50

[58] Field of Search ..... 100/1, 2, 34; 53/390, 53/592; 211/50; 206/83.5, 449, 451, 555

[56] References Cited

U.S. PATENT DOCUMENTS

| | | | |
|---|---|---|---|
| 315,044 | 4/1885 | Luce et al. | 100/34 |
| 2,321,802 | 6/1943 | Deubener . | |
| 2,364,518 | 12/1944 | Clouser | 100/34 |
| 2,485,419 | 10/1949 | Thompson | 100/34 |
| 2,522,833 | 9/1950 | Maccaferri . | |
| 3,038,403 | 6/1962 | Orelind | 100/34 |
| 3,357,344 | 12/1967 | Pate | 100/34 |
| 4,681,032 | 7/1987 | McDermott | 100/34 |
| 4,926,748 | 5/1990 | Smith et al. | 100/34 |
| 5,533,318 | 7/1996 | Murat | 100/34 |

FOREIGN PATENT DOCUMENTS

| | | | |
|---|---|---|---|
| 21223 | 5/1916 | Denmark . | |
| 756584 | 12/1933 | France . | |
| 2738468 | 3/1979 | Germany | 100/34 |
| 2935175 | 3/1981 | Germany . | |
| 9006050.4 | 9/1990 | Germany . | |
| 9102021.2 | 6/1991 | Germany . | |
| 88035449 | 4/1990 | Sweden . | |
| 2093686 | 9/1982 | United Kingdom . | |

OTHER PUBLICATIONS

ICA-KURIREN, vol., No. 5, 1972, IB, Goteborg, "PAKET-PINNE," Fig. 1.

*Primary Examiner*—Stephen F. Gerrity
*Attorney, Agent, or Firm*—Ostrolenk, Faber, Gerb & Soffen, LLP

[57] ABSTRACT

A device for collecting and packing paper material comprises a receptacle having a mainly square-shaped bottom, back and front walls, and two side walls. A box may be fixed either to the exterior surface of the back wall or to the exterior surface of one of the side walls for loosely retaining a string bobbin. The free end of a string wound onto the bobbin passes through an adjacent aperture in the side or back wall. String lengths are obtained using a knife preferably fixed to a slit in one of the side walls for cutting the string when pulled out to a suitable length through the aperture. A dummy knife is fixed to any corresponding slit or slits made in other walls but not needed for a knife. The string lengths are fixed in a holder arranged in the back and front walls. The string lengths are kept freely movable in the front wall holder. When tied using the string lengths, the pile of paper material is lifted from the receptacle via a handle having hooks introduced under the string lengths. The device is preferably delivered in form of a construction kit.

22 Claims, 5 Drawing Sheets

Section III

Section IV

WASTE PAPER COLLECTING DEVICE

TECHNICAL FIELD

The present invention refers to a device to be used for collecting and packing together paper material like papers, journals, print-outs or the like for re-utilization.

PRIOR ART

Such a device is known in the art as evidenced by DE-A-27 38 468. The device described therein comprises a receptacle having a mainly square-shaped bottom, a back wall and two, oppositely situated side walls. A holder is arranged for keeping a pair of string lengths in a position running mainly vertically along the inside of the back wall to the bottom of the receptacle and then mainly horizontally along the bottom to the front edge of the receptacle.. The string lengths have end portions easily attainable at the top of the back wall and the front edge respectively to be used when the receptacle is holding a pile of paper material to be packed by timing the pile together with the respective one of the string lengths. Then the package of paper material so obtained can be lifted from the receptacle.

Similar devices are described in DE-U-90 06 050 and in DE-U-91 02 021.

Thus, devices of the type mentioned above have been known for a relatively long time. However, they have not come to be commonly used obviously due to the fact that the stacked paper material is not easily handled and does not form a stable package which can be lifted from the receptacle. Thus, it has been established that it is rather troublesome to obtain a correct length of string when preparing the receptacle for collecting the paper material. It is also necessary to make use of separate tools, like a pair of scissors, to cut the string into suitable lengths. The string stored on a spool or bobbin has a tendency to jam when stored as proposed in the documents mentioned above.

Furthermore, after having built up a stack of paper material, the accessibility of the string lengths is obstructed as they are held in the holder. As a result a loosely formed package is obtained which, if carried by grasping the string lengths, is prone to fall apart.

Another bundling device is known from U.S. Pat. No. 4,681,032 describing the use of specially designed ties for packing waste paper and the like together. To obtain tightly bundled packages, the ties are arranged in a crossway fashion and are clamped together with special fasteners. As the ties as well as the fasteners are consumable articles, the proposed device is rather expensive in use.

SUMMARY OF THE INVENTION

The object of the present invention is to obtain a economically sound method of collecting waste paper like papers, journals, print-outs and the like, by providing an improved device of the type described above using ordinary string types.

According to one aspect on the invention, a device to be used for collecting and packing together paper material like papers, journals, print-outs or the like for re-utilization, comprises a receptacle having a mainly square-shaped bottom, a back wall and two, oppositely situated side walls. A holder is arranged for keeping a pair of string lengths in a position running mainly vertically along the inside of the back wall to the bottom of the receptacle and then mainly horizontally along the bottom to the front edge of the receptacle. The string lengths have end portions easily accessible at the top of the back wall and the front edge, respectively. When the receptacle is holding a pile of paper material to be packed, the pile is tied together with the string lengths and a package of paper material which can be lifted from the receptacle is obtained. The device is characterized in that at least one knife element is retained in a slit made in one or more of the walls and used when cutting the string, stored in a box at the exterior surface of one of the walls, into suitable running lengths.

By having a device according to the present invention comprising at least one knife element retained in a slit made in any one of the walls, it is possible to easily facilitate the handling of the collected paper material.

The string is stored on a spool or bobbin which is kept inside a separate box, e.g., connected to the back of the back wall of the receptacle. The string is easily cut into suitable lengths by the knife element incorporated into the receptacle.

By designing the knife element as an exchangeable element disclosed in a slit (preferably made in at least one side wall of the receptacle), one obtained a child-proof cutting device. In particular, the slit is formed of a centrally located bottom groove where the knife element is reached through slit portions made in the interior and exterior surfaces of the side walls. The width of the slit portions is somewhat smaller than the opening of the knife element introduced in the bottom groove.

To make sure safe and unjammed feeding of the string from the spool or bobbin stored in the box at the back of the back wall is obtained, the present invention involves a special feeding device designed as an oblong aperture in the back wall through which the string can be pulled from the spool or bobbin to the suitable length before being cut by the knife. The length of the aperture corresponds to the length of the spool or bobbin, preferably being three fourths of the spool or bobbin length.

Another favorable improvement according to the present invention for obtaining easy and safe handling of the string lengths after being cut, is found in the design of the holder, which is in form of keyholes. By having a recess which is open at the top edge portion of the front and back walls of the receptacle (for introduction of the string length) and by widening of the recess to a wider circular hole at the bottom end, makes possible the free movement of the string length at the front wall. Such a free movement is important for arranging the string lengths inside the receptacle after having cut the string into suitable lengths to allow them to freely adjust when loading paper material in the receptacle.

According to another aspect on the present invention, a favorable improvement of the device is obtained in that the device to be used for collecting and packing together paper material like papers, journals, print-outs or the like for re-utilization, comprises a receptacle having a mainly square-shaped bottom, a back wall and two, oppositely situated side walls. A holder is arranged for keeping a pair of string lengths in a position running mainly vertically along the inside of the back wall to the bottom of the receptacle and then mainly horizontally along the bottom to the front edge of the receptacle. The string lengths have end portions easily attainable at the top of the back wall and at the front edge, respectively. When the receptacle is holding a pile of said paper material to be packed, the pile is tied together with the string lengths and a package of paper material which can be lifted from the receptacle is obtained. The device is characterized by a handle for lifting the pile of paper material when tied together with the string lengths.

The handle is made from a metal wire surrounded by a hand friendly carrier which extends from the ends of the carrier in the form of angled hooks at each side of the carrier. The hooks are introduced under the string lengths after having tied the pile together. The package of paper material may thus be lifted from the receptacle.

Advantageously, the device according to the present invention is delivered in form of a construction kit having few components which are easy to join together without any tools or adhesives. Thus, each component includes cooperating pegs and recesses connectable with corresponding element of another component.

BRIEF DESCRIPTION OF THE DRAWINGS

The present invention will become apparent after considering the more detailed description given below with respect to some preferred embodiments, given as examples only, of the present invention shown in the drawings, where FIG. 2 is a perspective view of a second embodiment of a combined bundling device and a waste paper receiving receptacle according to the present invention.

DESCRIPTION OF THE PREFERRED EMBODIMENTS

Figure 1:
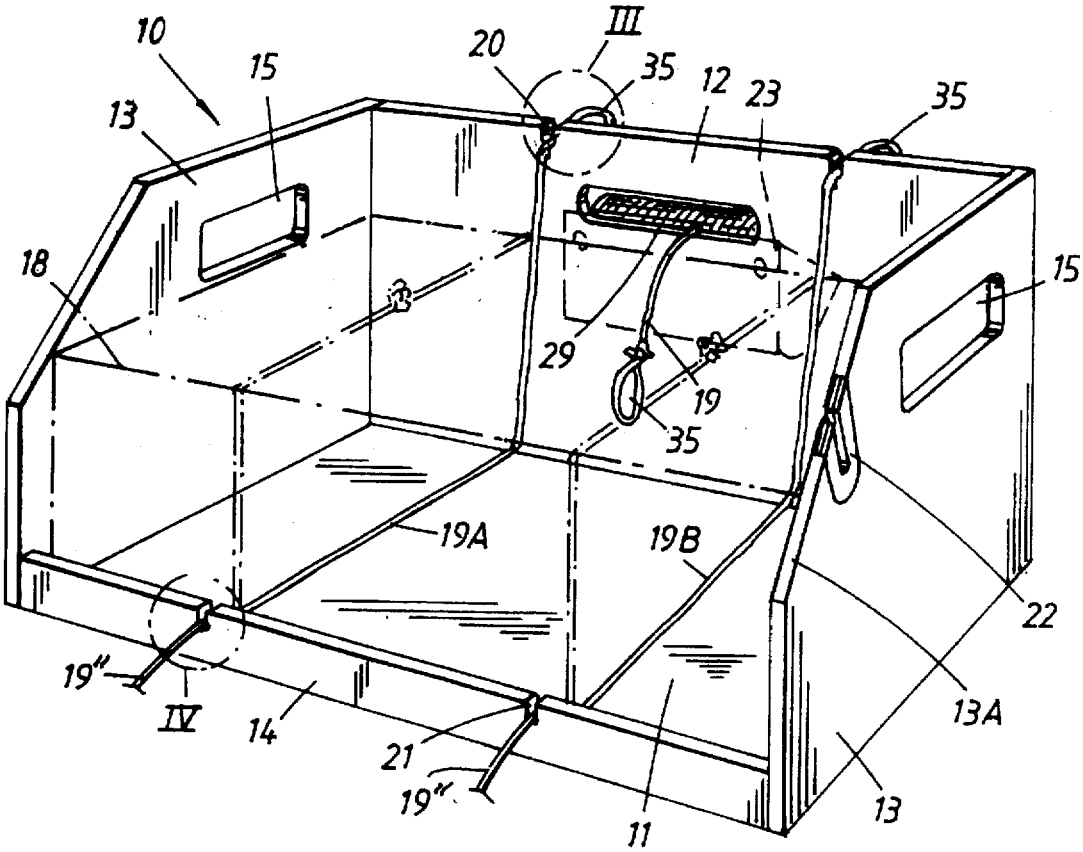
FIG. 1 is a perspective view of a first embodiment of a combined bundling device and a waste paper receiving receptacle according to the present invention.

The receptacle 10 of the device for collection of paper material according to the present invention can be made from different suitable materials like wood, as shown in FIG. 1, or plastic material as shown in FIG. 2. The receptacle 10 comprises a mainly square-shaped bottom 11, a back wall 12 arranged at one long side of the bottom 11, two side walls 13, and a front wall 14 at the long side opposite to the back wall 12. The front wall 14 has a lower height compared to the height of the other walls 12 and 13.

Due to the very small height of the front wall 14, the receptacle 10 is open not only upwards but also along most of the front portion. Thus, the user of the device obtains easy and comfortable access to the inside of the receptacle 10.

To make it possible for the user to move the device, if desired, the side walls 13 are provided with a handle opening 15 close to the top of each one of the side walls 13.

Figure 11:
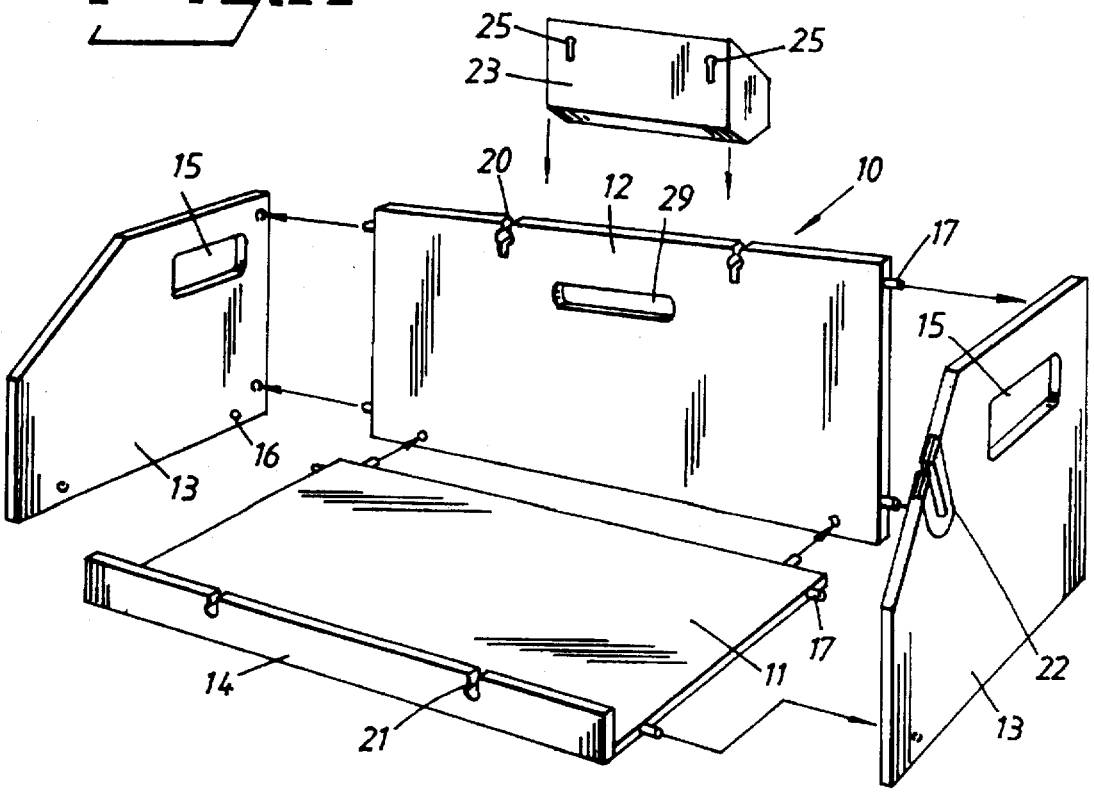
FIG. 11 is an exploded view of a construction kit for a complete combined bundling device and receptacle as shown in FIG. 1, FIGS. 12 and 13 are detailed cross section side views of preferred fastening means for joining separate components of the receptacle included in the construction kit according to FIG. 11, where

With the aim of making the transport of the device to the user more simple and cost effective, it is suitable to deliver the device in form of a construction kit comprising few elements which are easy to join without tools and adhesives. FIG. 11 illustrates such a construction kit for a complete combined bundling device and receptacle 10 as shown in FIG. 1. The kit includes four main parts, namely the bottom 11 with attached front wall 14, the back wall 12 and the two side walls 13. A preferred method of assembling the parts is to make use of force fitting elements like pegs 17 inserted into recesses 16. With such elements, the receptacle 10 can be assembled by just squeezing the parts together without any tools.

Figure 12:
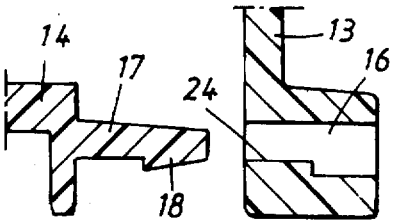
FIG. 12 shows the details before joining and FIG. 13 shows the same details after being joined.
Figure 13:
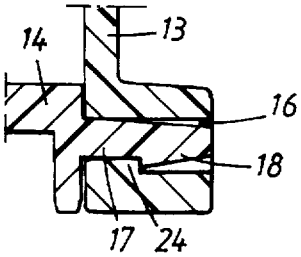

With respect to a receptacle 10 made from plastic material, such as the one shown in FIG. 2, the pegs 17 and recesses 16 may be designed as shown in FIGS. 12 and 13. FIG. 12 shows the end of the front wall 14 to be fastened to the side wall 13 and FIG. 13 shows the completed joint. In such a case the peg 17 has taken the shape of a hooked lock 18, while the cooperating recess 16 has a ridged part 24.

Figure 10:
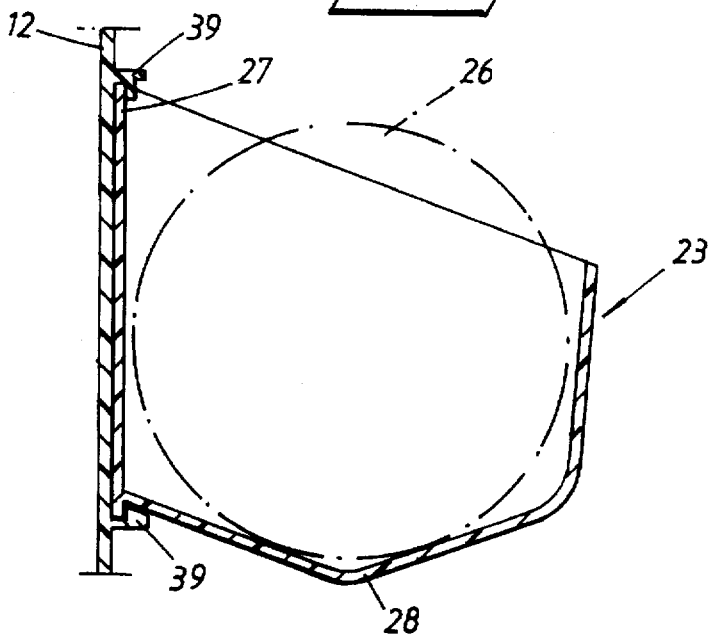
FIG. 10 is a cross sectional view of the string bobbin box at the back of the back wall of the receptacle shown in FIGS. 1 and 2.

Furthermore, the construction kit involves a box 23 which is, for example, mounted at the back wall 12. In the case of a receptacle 10 made of wood or similar material, the box 23 may be attached to the back wall 12 by hanging hooks (not shown) cooperating with holes 25 made in the box front wall 27. Another method of attaching the box 23, suitable for a receptacle 10 made from plastic material and the like as shows in FIG. 2, is the use of lips 39 (FIG. 10) arranged on the wall 12 gripping the edges of the box 23. To make it possible to connect the box 23 also to the exterior of the side walls 13, similar lips 39 are arranged at each side of the opening 15.

The box 23 is used for loosely storing a bobbin or spool 26 of string 19. A preferred design of the box 23 is made clear by a cross sectional view shown in FIG. 10. Thus, the box front wall 27 is connected to the receptacle back wall 12. The bottom 28 of the box 23 is derided in two length sections inclined towards each other for keeping the bobbin or spool 26 centered within the box 23 independent of the length of the string 19 on the bobbin or spool 26. Thus, the box is loaded with a bobbin or spool 26 having an elongated shape just by dropping the bobbin or spool 26 inside the box 23 having a length corresponding to the bobbin or spool 26. There are no fastening means in the box 23 but the bobbin or spool 26 just rests on the sections of the bottom 28.

The free end of the string 19 from the bobbin or spool 26 resting in the box 23 passes through an oblong aperture 29 made in the back wall 12 of the receptacle 10. Thus, the string 19 can be pulled out from the bobbin or spool 26 through the aperture 29. If fixed to anyone of the side walls 13 the string 19 passes through the opening 15, thus corresponding to the aperture 29 in the back wall 12.

To overcome the risk of having a string jam within the box 23, it has been found suitable to give the aperture 29 (or the opening 15) a length being approximately three fourths of the length of the bobbin or spool 26, which in turn is of about the same length as the box 23. The aperture 29 (or the opening 15 where appropriate) is centered with respect to the length of the box 23 as shown in FIGS. 1 and 2.

To solve the problem of obtaining suitable string lengths 19A, 19B cut from the string 19 when pulled out from the aperture 29 (or opening 15), the receptacle 10 is equipped with at least one knife assembly 22. Such a knife assembly 22 is suitably arranged in the side walls 13 as shown in FIGS. 1 and 2. Preferably, the knife assembly 22 is arranged in a slit 30 made in the side wall(s) 13.

Figure 5:
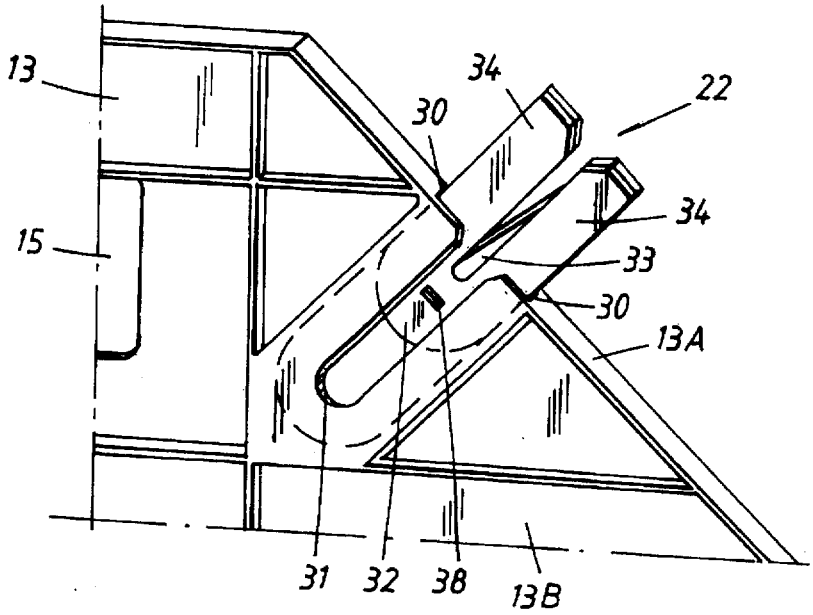
FIG. 5 is a detailed side view in an enlarged scale of the knife used in the bundling device of FIGS. 1 and 2.

A preferable embodiment of the knife assembly 22 is shown being inserted in the side wall 13 in FIG. 5. The slit 30 is made in form of a bottom groove 31 extending from the front edge surface 13A of the side wall 13. The bottom groove 31 is given mainly the same dimensions as the exterior measures of the knife 22. The knife 22 is introduced from the front edge surface 13A and is thereby exchangable. The bottom groove 31 has side slit portions made in the respective interior and exterior surfaces 13B of the side wall 13. To make it easier to force the knife 22 out from the slit 30 there is a small shoulder 38 on the exterior surfaces of the cover 32 which can be acted on manually.

As shown in FIG. 5 the knife assembly 22 includes a cover 32 of mainly a U-shaped design. A knife blade 33 is carried between the stems 34 of the U-shaped cover 32. The width of the side slit portions made in the interior and exterior surfaces 13B of the side wall 13 are somewhat wider than the opening formed between the stems 34 of the U-shaped cover 32. By such a design a child-proof knife 22 is obtained.

Figure 6:
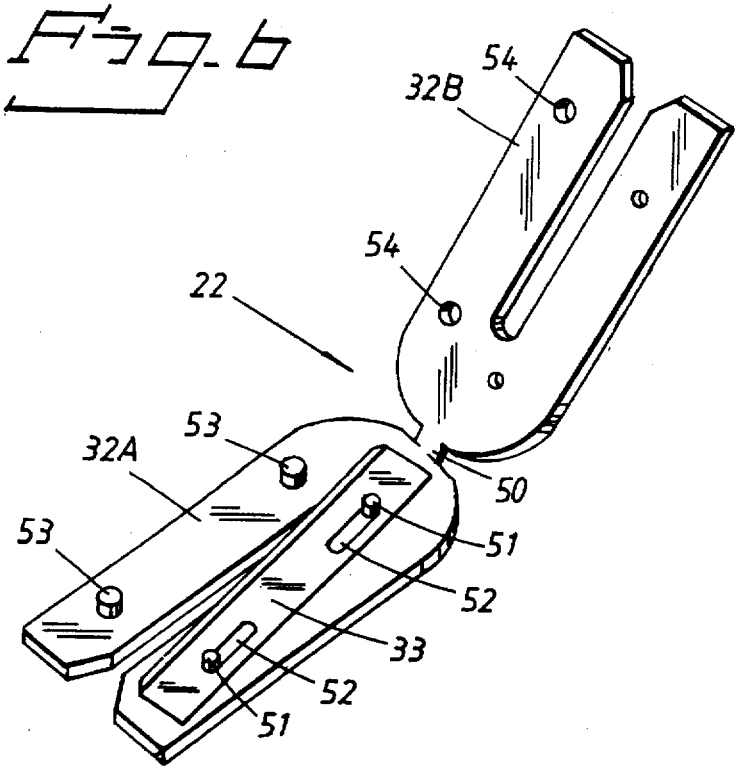
FIG. 6 is a perspective view of a disassembled knife.

FIG. 6 is a perspective view of a disassembled knife assembly 22. The cover 32 is made from a plastic material suitably molded in two halves 32A, 32B connected with each other by a thin hinge portion 50. The two halves 32A, 32B have a mirror-inverted design with respect to each other and are to be folded together around a metal knife blade 33 forming a sharp angle to the length axis of the opening formed between the stems 34 (FIG. 5) of the cover 32. The metal knife blade 33 is kept in place by support pins 51 projecting from the interior surface of one (32A) of the two halves and passing through corresponding openings 52 made in the knife blade 33.

By folding the two cover halves 32A, 32B together they are maintained in a fixed closed position by snap action generated by pegs 53 co-operating with holes 54. Though the pegs 53 and holes 54 are shown in separate halves 32A, 32B, both the halves may have co-operating pegs and holes.

If slits 30 are made in both the side walls 13 and only one of the slits 30 are to carry a knife 22, the other slit may be covered by a dummy 36 as shown in FIG. 2. The dummy 36 takes the same exterior shape as the knife 22 but is preferably made of solid material.

By using the device according to the present invention, the paper material, like old papers and journals and/or data print-outs, is stacked on the bottom 11 of the receptacle 10 as indicated by the pile 18 shown by dot dashed lines in FIG. 1.

Before starting to stack the paper material, the receptacle 10 is prepared in the following way.

Figure 14A:
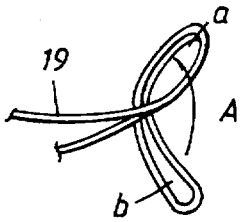
FIGS. 14A–C are examples of how to prepare a safe knot for tieing the collected paper material.
Figure 14B:
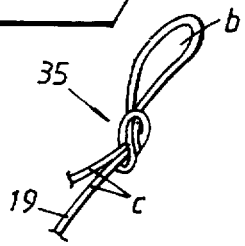

The string 19, introduced through the aperture 29, is provided with a special running knot 35 to be explained in more detail in connection with FIGS. 14A–C. Then the string 19 is pulled out from the bobbin or spool 26 to a suitable length. Such a suitable length is preferably three times the distance L between a cutting slit 30 and the furthest away situated holder 20 as indicated in FIG. 2.

Figure 3:
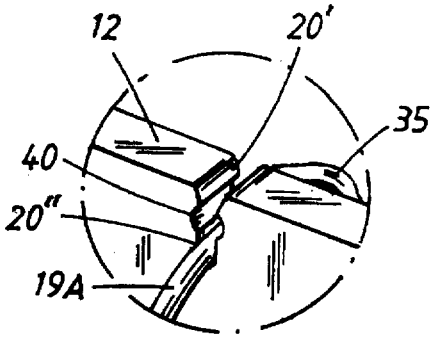
FIGS. 3 and 4 are detailed perspective views in an enlarged scale to show the design of the holder arranged respectively in the front and back walls of the receptacle shown in FIGS. 1 and 2.

Thus, after having cut a suitable string length 19A or 19B from the string 19 by making use of the knife 22, the string length 19A or 19B has a knot 35 at one end thereof and the opposite end 19" is free. Two string lengths 19A and 19B are cut and are arranged in parallel inside the receptacle 10. The one end of the string lengths having the knot 35 is fastened within a holder 20 at the edge of the back wall 12 as shown in FIG. 3. The holder 20 has got the shape of a key hole recess. To make the insertion of the string length 19A (or 19B) easier, the key hole end opening 20' is funnel-shaped. At the bottom end portion 20" the key hole 20 is made rather narrow for fixing the string length 19A (or 19B) in a reliable fashion. The portion 40 of the recess is made circular to be used as a retainer hole for holding of handle 41 as discussed below in connection with FIGS. 7, 8 and 9.

Figure 4:
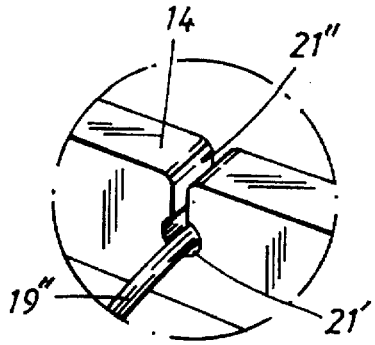

The opposite ends of the string lengths 19A, 19B are arranged for freely moving in the holder 21 as shown in FIG. 4. Also the holder 21 has the shape of a key hole with a funnel-shaped end opening 21" and a bottom end portion 21' having a circular shape, the diameter of which is larger than the string 19.

Thus, before stacking the paper material, the string lengths 19A and 19B are cut and positioned inside the receptacle 10 as shown in FIGS. 1 and 2. When the stacked collection of paper material 18 (FIG. 1) has obtained a level just under the handle openings 15, it is time for bundling the stack 18 by using the string lengths 19A, 19B. The ends 19" and 35 of the string lengths 19A, 19B are disengaged from the holder 20 and 21, the free end 19" being inserted in the knot 35 as described more in detail below in the discussion of FIGS. 14A–C.

Figure 8:
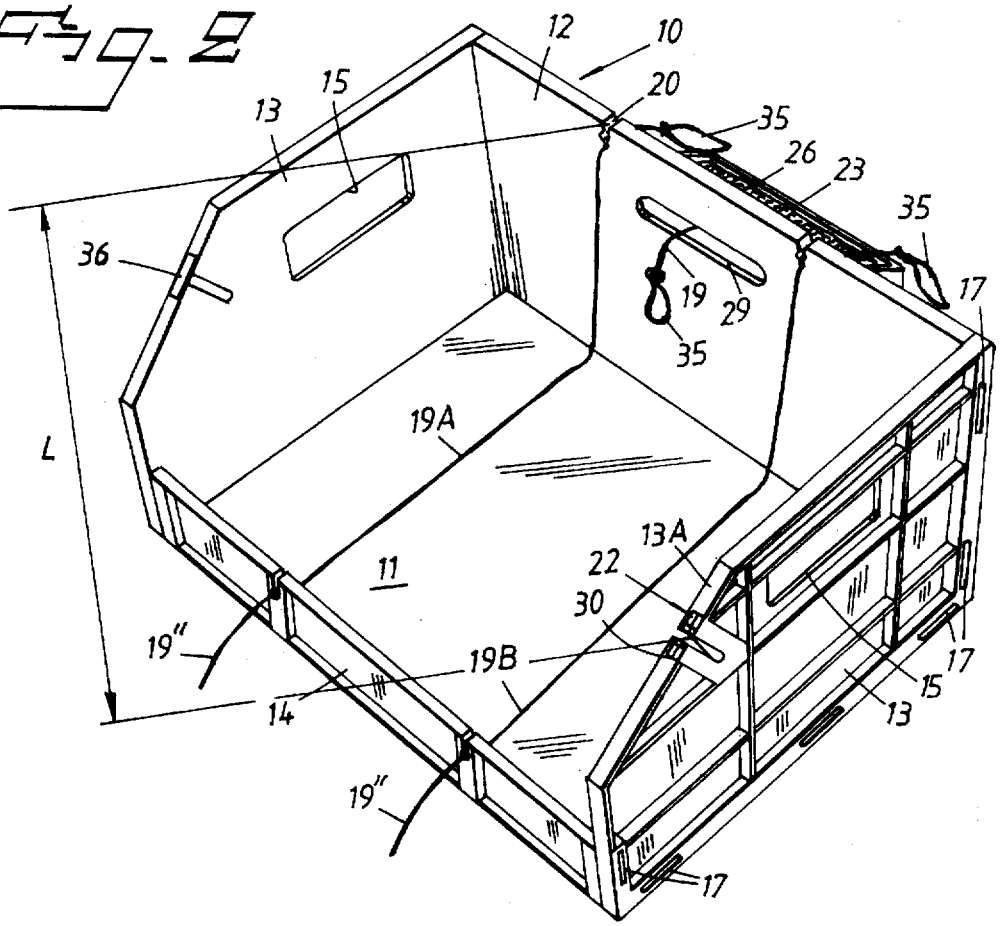
FIG. 8 is a side view of the handle shown in FIG. 7.
Figure 7:
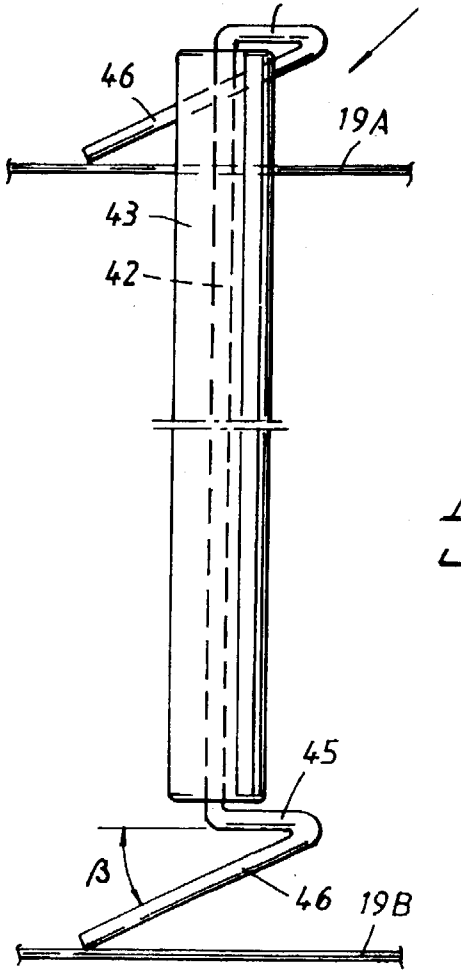
FIG. 7 is a top view of the handle for lifting the completed package of paper material from the receptacle.

To facilitate lifting out the pile of tied paper material 18 from the receptacle 10, a handle 41 according to the invention is used. As shown in FIGS. 7 and 8, the handle 41 is made from a metal wire 42 surrounded by a hand friendly carrier 43. From the ends of the carrier 43 the metal wire 42 protrudes in form of angled hooks 44 at each side of the carrier 43. The hooks 44 are formed at a level below the carrier 43 and each one of the hooks 44 comprises two parts 45, 46 of the metal wire 42. At one end the first part 45 is oriented at a right angle to the carrier 43. At the opposite end of the first part 45, the second part 46 extends at an angle $\alpha$ of about 45 degrees with respect to the direction of the first part 45. The second part 46 also forms an angle $\beta$ of about 45 degrees to a plane P, which plane P is parallel to the direction of the string lengths 19A, 19B to be lifted.

Figure 9:
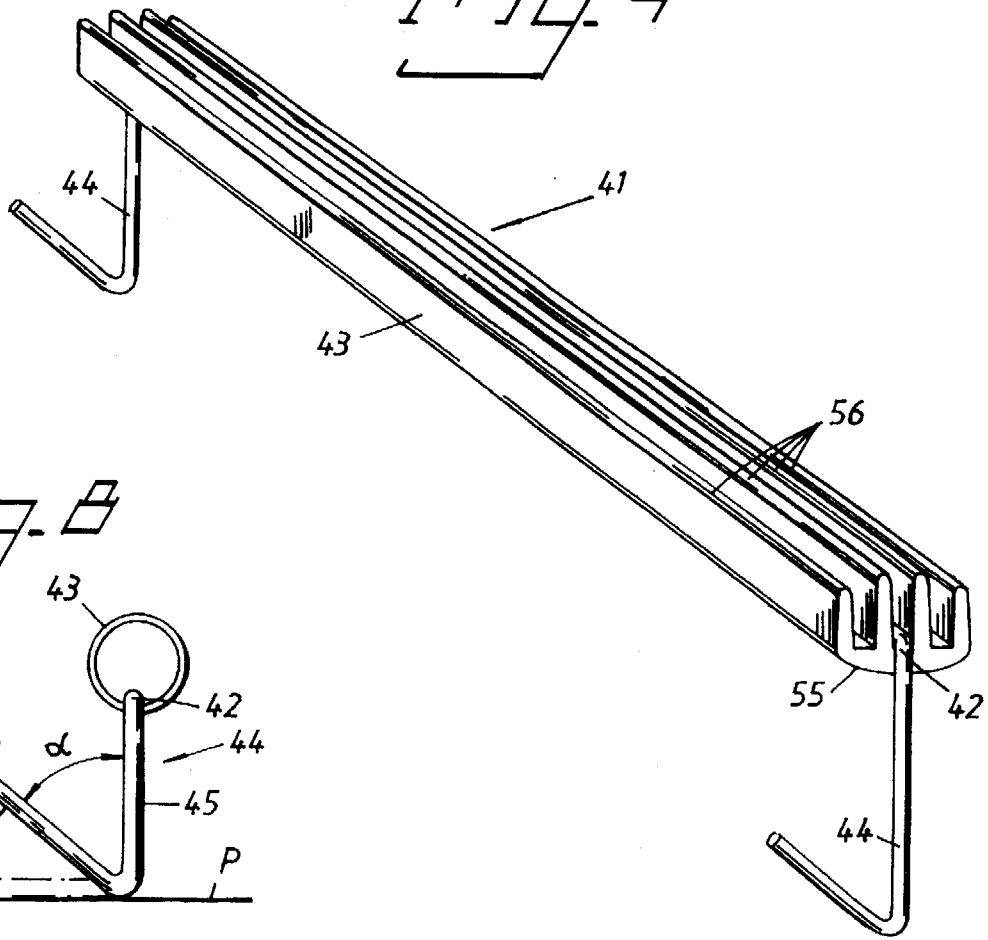
FIG. 9 is a perspective view of a preferred embodiment of the handle.
Figure 8:
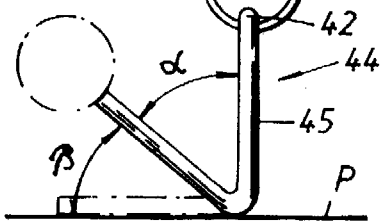

A preferred design of the handle 41 is shown in FIG. 9. The carrier 43 has a cam shaped cross section with an arched flat bottom wall 55 from which flange like ribs 56 extend in an upward direction. The metal wire 42 is fixed between a pair of the ribs 56 and protrude as angled hooks 44 at each side of the carrier 43 similar to the construction as shown in FIGS. 7 and 8. Besides being easy to manufacture the carrier shown in FIG. 9 is extremely hand friendly.

When making use of the handle 41, the second part 46 of the hooks 44 is placed in the plane P and is introduced below the string lengths 19A, 19B as indicated in FIG. 8 by the dashed lines. When hooking the string lengths 19A, 19B the pile of paper material 18 can be lifted with ease by the handle 41.

The handle 41 according to the invention has the advantage that the pile of paper material 18 can be lifted by one hand, the other hand being used for keeping the receptacle 10 in place. Furthermore, it will not disarrange the string lengths 19A, 19B.

When not used, the handle 41 is kept by the retainer holes 40 of the holder 20 of the back wall 12 as described above. Thus, the metal legs 45, 46 of the handle 41 are inserted in the retainer holes 40.

To obtain safe and easy handling of the tied pile of paper material 18 it is important to use suitable types of knots. In FIGS. 14A–C a preferred method of making such suitable knots is shown. The knot 35 being prepared at the free end of the string 19 at the aperture 29 (FIGS. 1 and 2) is preferably made in the following way. The string 19 is folded double as shown in FIG. 14A and then the loop k is once more folded in the direction of the arrow A to form a further loop a, into which the first loop b is introduced. By pulling the loop b when keeping the string ends c with a firm hand a safe knot 35 is obtained as shown in FIG. 14B.

Figure 14C:
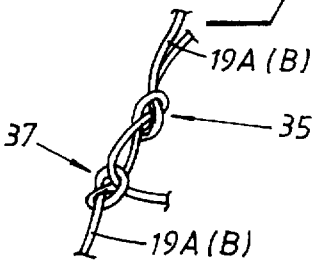

When tieing the package of paper material, the free end 19" (FIGS. 1 or 2) of the string length 19A or 19B is introduced through the loop b of the knot 35 and a simple knot 37 is made as shown in FIG. 14C. By doing so, a slip safe joint is obtained.

Though having described and shown the invention in connection with a preferred embodiment thereof, it may well be modified in different ways without departing from the inventive idea. Therefore the invention must not be restricted to the embodiment shown on the drawings or described above but is only defined by the following claims.

I claim:

1. A device for collecting and bundling paper material comprising:

a receptacle having a substantially rectangular-shaped bottom and a back wall, two spaced apart side walls coupled to the bottom and back walls;

holders for retaining a pair of string lengths in a position running substantially vertically along the inside of the back wall to the bottom of the receptacle and substantially horizontally along the bottom wall to the front edge of the receptacle, the string lengths having end portions easily accessible at the top of the back wall and the front edge, respectively, the paper material being packed by tieing the paper material together with the string lengths and obtaining a package of paper material which can be lifted from the receptacle;

at least one knife element disposed in a slit made in at least one of the walls for use when cutting the string into suitable lengths; and a box disposed on an exterior surface of one of the walls the box loosely retaining a string bobbin, the free end of the string emanating from the bobbin passing through an aperture in the wall into the receptacle such that the string can be pulled out from the bobbin to a suitable length, cut by the knife element and arranged in the holders.

2. A device according to claim 1, wherein a slit is disposed in both the side walls of the receptacle.

3. A device according to claim 1, wherein the bobbin has an oblong shape and a length which is substantially the same as the length of the box.

4. A device according to claim 1, wherein the aperture is centered in the wall above the upper edge of the box, the aperture having a length of substantially three fourths of the inside length of the box.

5. A device according to claim 1, wherein the bottom of the box is divided in two length sections inclined towards each other for keeping the bobbin centered within the box independent of the length of the string left on the bobbin.

6. A device according to claim 1, wherein the oblong aperture is made in the back wall of the receptacle and is centered with respect to an attachment means for the box at the exterior surface of the back wall.

7. A device according to claim 1, wherein the holders are in the form of a keyhole shape having a recess being open at the top edge portion of the back and front walls for introduction of respective string lengths.

8. A device according to claim 7, wherein the recess of the holders made in the front wall has a wider bottom section in form of a circular hole for permitting free movement of the string length.

9. A device according to claim 1, wherein the receptacle is in the form of a construction kit having components which are joined without requiring any tools or adhesives.

10. A device according to claim 9, wherein the receptacle components are made from plastic material or wood.

11. A device according to claim 9, wherein at least some components include cooperating pegs and recesses for being joined together.

12. A device according to claim 11, wherein each peg has the shape of a hooked lock to cooperate with a corresponding ridge in the recesses.

13. A device for collecting and bundling paper material comprising:

a receptacle having a substantially rectangular-shaped bottom and a back wall, two spaced apart side walls coupled to the bottom and back walls;

holders for retaining a pair of string lengths in a position running substantially vertically along the inside of the back wall to the bottom of the receptacle and substantially horizontally along the bottom wall to the front edge of the receptacle, the string lengths having end portions easily accessible at the top of the back wall and the front edge, respectively, the paper material being packed by tieing the paper material together with the string lengths and obtaining a package of paper material which can be lifted from the receptacle; and at least one knife element disposed in a slit made in at least one of the walls for use when cutting the string into suitable lengths, the knife means being exchangeably arranged in the slit and having a cover of substantially U-shaped design, the knife element including a knife blade being disposed at an angle to the opening formed between opposing stems of the U-shaped cover.

14. A device according to claim 13, wherein the slit made in the side wall for the knife element is defined by a bottom groove in a front edge surface of the side wall, the bottom groove having substantially the same dimension as the exterior dimensions of the knife element, the knife element being introducible from the front edge surface, the bottom groove having slit portions made in interior and exterior surfaces of the side wall somewhat smaller than the opening formed between the stems of the U-shaped cover.

15. A device according to claim 14, wherein a knifeless dummy is introduced into at least one slit of a wall not receiving a knife element.

16. A device according to claim 13, wherein the cover of the knife element comprises two plastic halves being of a mirror-inverted design of one another, the halves being coupled via a hinge and are folded together to engage a metal knife, the edge of the knife being directed to form a sharp angle with a slot in the cover.

17. A device according to claim 16, wherein the hinge connection between the two halves of the cover is arranged at the bottom end of the U-shaped cover, such that, when folded together, the halves are maintained in a fixed position by snap action pegs which co-operate with corresponding holes.

18. A device according to claim 16, wherein the metal knife includes at least two openings, each opening cooperating with a support pin projecting from an interior surface of at least one of the cover halves.

19. A device for collecting and bundling paper material comprising:

a receptacle having a substantially rectangularly-shaped bottom and a back wall, two spaced apart side walls coupled to the bottom and back walls;

holders for retaining a pair of string lengths in a position running substantially vertically along the inside of the back wall to the bottom of the receptacle and substantially horizontally along the bottom wall to the front edge of the receptacle, the string lengths having end portions easily accessible at the top of the back wall and the front edge, respectively, the paper material being packed by tieing the paper material together with the string lengths and obtaining a package of paper material which can be lifted from the receptacle;

a handle for lifting the pile of paper material when tied together with the string lengths, the handle being made from a metal wire which is surrounded by a hand friendly carrier such that the metal wire protrudes from the ends of the carrier and forms angled hooks at each side of the carrier, the hooks being operatively coupled to the string lengths for lifting the package of paper material from the receptacle.

20. Amended device according to claim 19, wherein the carrier has a cam shaped cross section with an arched flat bottom wall from which at least two flange-like ribs extend in an upward direction, the metal wire being fixed between a pair of the ribs.

21. A device according to claim 19, wherein each one of the hooks of said handle comprise a first part of the metal wire being coupled to and forming a right angle to the carrier at one end and, at the other end, being coupled to a second part of the metal wire, the second part forming a first angle of about 45 degrees with respect to the first part and a second angle with respect to a plane which is parallel to the direction of the string lengths to be lifted.

22. A device according to claim 19, wherein the holders are made in the back wall and have a wider retainer hole below the top end opening of the recess for holding the handle when not used.

* * * * *